US006691440B1

(12) United States Patent
Petz et al.

(10) Patent No.: US 6,691,440 B1
(45) Date of Patent: Feb. 17, 2004

(54) DEVICE FOR ARTIFICIALLY SIMULATING A FIRE

(75) Inventors: Günter Petz, Nürnberg (DE); Martin Betz, Zirndorf (DE); Günter Lunscher, Zimdorf-Weiherh (DE)

(73) Assignee: Glen Dimplex Deutschland GmbH, Sonneberg (DE)

( * ) Notice: Subject to any disclaimer, the term of this patent is extended or adjusted under 35 U.S.C. 154(b) by 0 days.

(21) Appl. No.: 09/857,856

(22) PCT Filed: Dec. 9, 1999

(86) PCT No.: PCT/DE99/03935

§ 371 (c)(1),
(2), (4) Date: Nov. 26, 2001

(87) PCT Pub. No.: WO00/34717

PCT Pub. Date: Jun. 15, 2000

(30) Foreign Application Priority Data

Dec. 9, 1998 (DE) ..... 198 56 742

(51) Int. Cl.[7] ..... G09F 15/06; F24C 15/06
(52) U.S. Cl. ..... 40/428; 392/348
(58) Field of Search ..... 40/428; 392/348

(56) References Cited

U.S. PATENT DOCUMENTS 2,984,032 A 5/1961 Cornell
3,526,984 A * 9/1970 Nielsen et al. ..... 40/428
4,890,600 A 1/1990 Myers ..... 126/512

FOREIGN PATENT DOCUMENTS

| | | | |
|---|---|---|---|
| DE | 1 679 173 | 4/1971 | |
| GB | 414280 | 8/1934 | |
| GB | 1164143 | 9/1969 | ..... F24C/15/06 |
| GB | 1 272 644 | 5/1972 | ..... F24C/15/06 |
| GB | 1 298 455 | 12/1972 | ..... G02B/27/00 |
| GB | 1 443 772 | 7/1976 | ..... F24C/15/06 |
| GB | 2 137 336 A | 10/1984 | ..... F24C/15/06 |
| GB | 2 151 772 | 7/1985 | ..... F24C/15/06 |
| GB | 2 240 171 A | 7/1991 | ..... F24C/15/06 |
| GB | 2 298 073 A | 8/1996 | ..... G09F/13/34 |

* cited by examiner

*Primary Examiner*—Cassandra H. Davis
(74) *Attorney, Agent, or Firm*—Morgan & Finnegan, LLP

(57) ABSTRACT

Device for artificially simulating a fire, in particular for use in the hearth of an open fireplace, having a housing in which, in order to simulate a fire, an artificial fuel bed into which moving, in particular strip-shaped, tongue-shaped or tab-shaped flame simulation elements whose image is reflected into the field of vision, and at least one light source for illuminating the fuel bed and/or the flame simulation elements are arranged, the flame simulation elements being arranged on at least one moving, motor-driven carrier element.

30 Claims, 2 Drawing Sheets

DEVICE FOR ARTIFICIALLY SIMULATING A FIRE

BACKGROUND OF THE INVENTION

The invention relates to a device for artificially simulating a fire. Such a device is used in particular to designate an artificial fire in a fireplace, which can be used in the hearth of an open fireplace if fire regulations and/or environmental laws do not permit open hearths to be operated, or the user of such a hearth prefers an artificial fire instead of an open fire in his room.

Prior Art

A device which is known from the GB patent 2,240,171 has a housing in which, in order to simulate a fire, an artificial fuel bed and moving, in particular strip-shaped, tongue-shaped or tab-shaped flame simulation elements whose image is reflected into the field of vision are provided. The fuel bed and the flame simulation elements are illuminated by means of at least one light source within the housing.

In the device according to the prior art, the tab-shaped flame simulation elements, which are lit from below, are arranged in the upper region of a housing. In order to move the flame simulation elements, a housing is provided which provides a flow against the elements in their longitudinal direction and thus brings about a licking flickering movement. The image of these flickering tongues is reflected by means of translucent or transparent glass panes, so that the image of the flickering tongues appears to leap out from the fuel bed.

This known device is disadvantageous in so far as the flame simulation can only generate a rather one-dimensional unrealistic image.

SUMMARY OF THE INVENTION

The invention is based on the object of developing a device with the features of the preamble of Patent Claim 1 in such a way that the flame simulation is more lively, less one-dimensional and more realistic.

This object is achieved in that the flame simulation elements are arranged on at least one moving, motor-driven carrier element.

The core of the invention is considered to be the fact that the carrier for the flame simulation elements which are strip-shaped, tongue-shaped or tab-shaped, or embodied in some other way, is move continuously or discontinuously. For this purpose, a motor-operated drive is provided. The motor-operated drive of the carrier element is used to ensure that the images of other flame simulation elements, which are also shaped or coloured differently, can be continuously reflected, whereas in the prior art the same flame simulation elements are always disadvantageously to be seen as an image in their different stages of movement.

The image of the flame simulation elements thus becomes more colourful, more varied and the flame simulation as a whole becomes more pleasant for the viewer. For example, it is conceivable to move different flame simulation elements which are coloured red, yellow, green or blue into the reflection area, as a result of which a colour variation in the flames is achieved without differently coloured illumination sources having to be switched on and off or dimmed.

In the invention it is also possible to use flame simulation elements which have different lengths or different shapes so that large flames and then small flames appear to leap out of the fuel bed.

It is of course also possible to use only flame simulation elements which are of the same colour, and to achieve different colours by means of light sources of different colours and/or with coloured panels attached at the front.

Different motor-operated drives are conceivable, for example a hot air blower which can advantageously be used if the device is provided with a heat source. In addition, hydraulic drives or lifting motors with a spring-operated lifting means or weight-operated lifting means are also possible.

The carrier element can be embodied in the manner of a rotating drum. Such a device is easy to manufacture and drive. The flame simulation elements are positioned in the upper region of the surface of the rotating drum and then become released from the surface of the drum pulled by gravity, so that they undergo a sudden movement. If this is included in the image presented, a particularly lively flame image is produced.

However, it is also possible to form the carrier element as a circulating belt. This increases the surface of the carrier element so that a greater number of, and a greater variety of, flame simulation elements can be arranged on the surface of the carrier element.

In addition, it is also possible to arrange a plurality of drum-like or wheel-like carrier elements on a motor-driven shaft, or to mount a plurality of drum-like or wheel-like carrier elements on an axle and to drive them separately or in groups. In the latter solution, the drive is not provided by means of the axle but rather, for example, peripherally by means of individual motor-operated drives which are arranged above or behind the carrier elements in such a way that their image is not also reflected.

In this case it is also possible to drive the carrier elements at different rotational speeds or different senses of rotation, as a result of which the image of the flames is even more varied. A drive which rotates in an oscillating fashion or moves to and fro is possible in principle.

Advantageously it is also possible to embody the carrier element in the manner of a rotating camshaft so that the flame simulation elements are at different distances from the axis of rotation, as a result of which different speeds of movement of the flame simulation elements (depending on the distance from the axis of rotation) are also achieved. A drum with diameters which are different in certain portions is also conceivable within the framework of the invention.

In addition it is also possible to superimpose on the carrier element not only its rotating movement but also an axial displacement or oscillation movement. This can be achieved by mounting the carrier element on a shaft which can be displaced axially by a certain amount counter to a spring force. At one end of the shaft it is then possible to provide a cam drive which provides a to-and-fro displacement movement of the carrier element at different speeds or as a function of a link element guide.

In principle it is also possible to provide a flow against the carrier elements in such a way that in addition to the motor-driven oscillating movement which is triggered by gravity an additional flickering movement may also occur. For this purpose, the carrier element is provided with air outlet openings, and a blower provides a flow onto the internal region of the carrier element.

In order to make the device or the image of the flames even more lifelike, the motor-operated drive can also be connected to a random generator in order to vary the speed, so that the carrier elements are driven slowly and then quickly again.

Furthermore, it lies within the scope of the invention to provide a programme controller which drives both light movements and also motor-operated movements. In this case, different fire programme can also be called, for example the crackling fire which is produced if very dry soft wood is used or the gentle slow burning of oak wood or beech logs.

In order to reflect the image of the flame simulation elements onto the fuel bed, at least one reflective element is arranged, preferably reflective, obliquely positioned plates are located one on top of the other, and they may also have different angles of inclination so that in each case a plurality of flame simulation elements is projected onto the fuel bed from different viewing angles.

If the plates are curved or chased upwards, a negative effect, which occurs if the viewer walks to and fro in front of the device and looks at the image of the flame simulation elements, is avoided. In the case of flat glass panes, there elements would actually migrate to and fro but with chasing of the glass panes this to-and-fro movement of the flame effect is suppressed.

For adjusting the speed or for programming the programme controller, in put elements may be provided such as programme selection switches, speed regulators, brightness regulators and the like.

It is also possible to install in the programme controller a timer which reduces the speed or the intensity of the light effects in the manner of a sloping curve so that the impression of a fire burning nice and slowly is produced. The final state of the programme then corresponds to a heap of glowing ashes without flames.

An improvement of the visual quality of the reflection of the image is achieved by means of a diffuser plate which is arranged under the carrier element.

The invention is explained in more detail with reference to exemplary embodiments in the figures in the drawing, in which:

DETAILED DESCRIPTION OF THE PREFERRED EMBODIMENT

Figure 1:
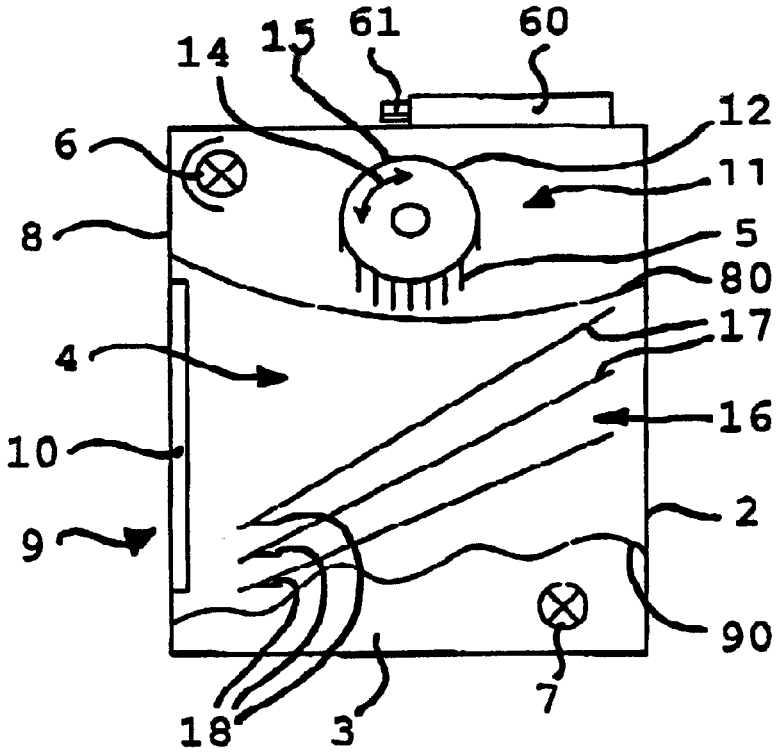
FIG. 1 shows a schematic sectional view through a first embodiment with a carrier element which is embodied in a drum-like manner.

The device 1 has a housing 2 in which, in order to simulate a fire, an artificial fuel bed 3, moving flame simulation elements 5, whose image is reflected into the field of vision 4, and light sources 6, 7 for illuminating the fuel bed 3 and the flame simulation elements 5, are arranged.

A viewing window 9, which can be closed off with a plate 10, is located on the front 8 of the housing 2.

In the exemplary embodiment illustrated in FIG. 1, the flame simulation elements 5, which are in the form of tongue-like tabs, are arranged on a moving carrier element 11 which is embodied in the manner of a rotating drum 12 and is mounted on a shaft 13 which is driven in rotation, i.e. in the sense 14 of the arrow, is driven by a motor (not illustrated).

In order to reflect the image of the flame simulation elements 5 which drop away downward from the drum 12 into the field of vision 4 of the viewer, and specifically in such a way that the flame simulation elements 5 appear to leap out of the surface of the fuel bed 3, reflective elements 16 are provided in the form of a plurality of obliquely positioned plates 17 by means of which the images of the flame simulation elements 5 are reflected.

The plates 17, for example composed of plastic or glass, may have different angles 18 of inclination with respect to the horizontal and thus generate a multiple image of the flame simulation elements 5, even when they are viewed from different heights.

Figure 2:
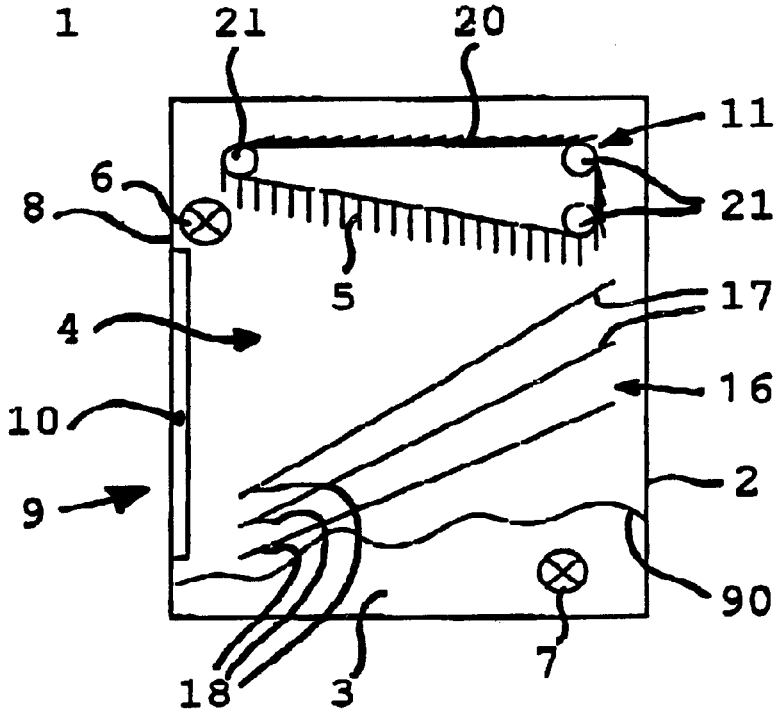
FIG. 2 shows a schematic sectional view through a further embodiment with a carrier element which is embodied as a circulating belt.

In the exemplary embodiment illustrated in FIG. 2, identical reference symbols are used for identical elements.

The carrier element 11 is however a circulating belt 20 which is mounted on a plurality of rollers 21 of which one is driven by a motor.

FIGS. 3–7 then shown different embodiments of carrier elements.

Figure 3:
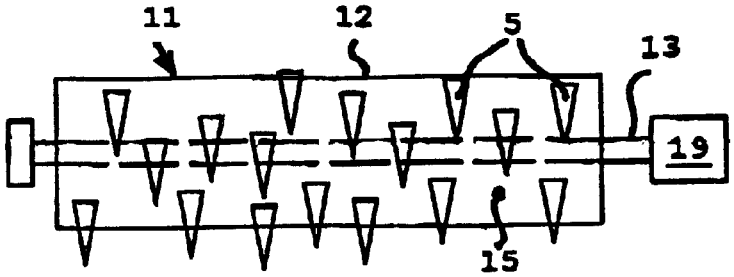
FIG. 3 shows a schematic plan view of a drum-like carrier element.

FIG. 3 shows the drum 12 which is mounted on the shaft 13. The motor-operated drum is designated by reference number 19.

Figure 4:
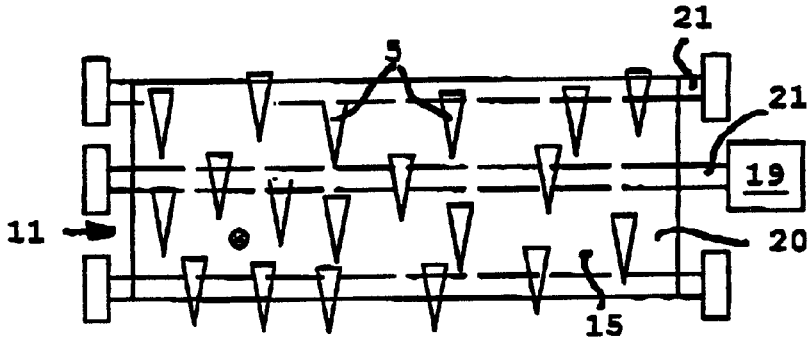
FIG. 4 shows a schematic plan view of a belt-like carrier element.

In FIG. 4, the belt 20 is mounted on the rollers 21. The drive 19 drives one of the rollers 21.

Figure 5:
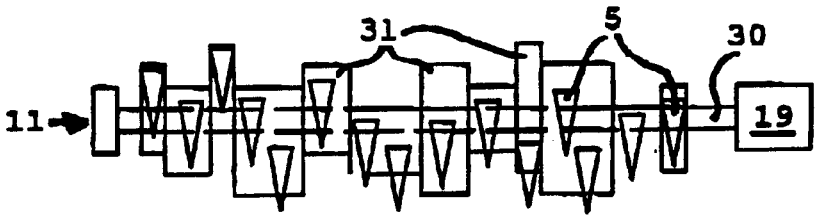
FIG. 5 shows a schematic plan view of a carrier element which is embodied in the manner of a camshaft.

In FIG. 5, a shaft 30 is provided on which eccentrically arranged cam elements 31, to which in turn the flame simulation elements 5 are secured, are located.

Figure 6:
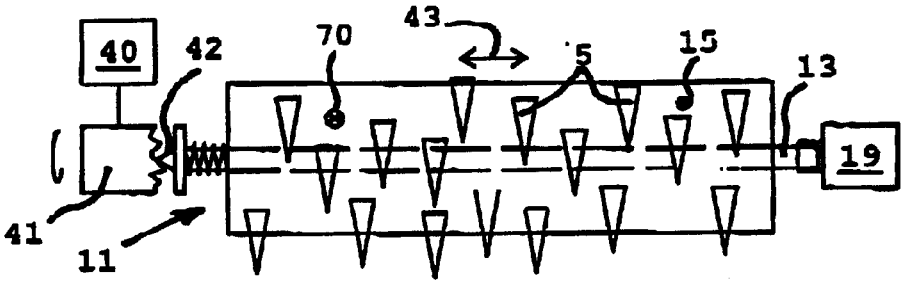
FIG. 6 shows a schematic view of a carrier element with a device for generating an oscillating to-and fro movement.

The carrier element 11 according to FIG. 6 corresponds largely to the carrier element 11 according to FIG. 3. However, the shaft 13 can be displaced laterally counter to spring force. On the side lying opposite the drive 19, an eccentric motor 40 is provided which drives an out-of-centre link element 41 which acts on the free cam end 42 of the shaft 13 and thus ensures that the roller 12 moves in the direction of the arrow 43.

Figure 7:
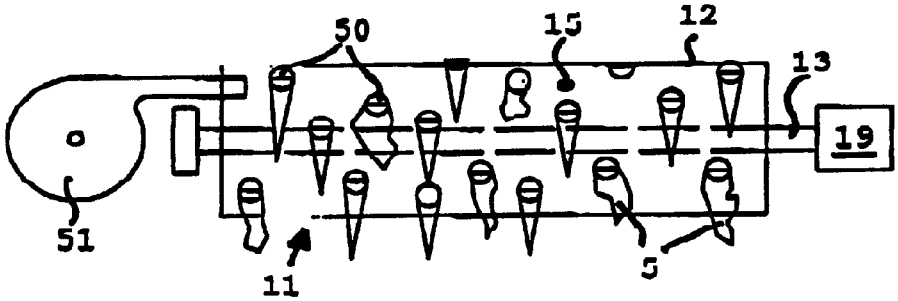
FIG. 7 shows a schematic plan view of a carrier element which is provided with air outlet openings.

In the exemplary embodiment according to FIG. 7, air outlet openings 50 are provided. A blower 51 blows air into the interior region of the drum 12. The air under excess pressure flows out of the air outlet openings 50 and causes the flame simulation elements 5 to move in a flickering way. The air outlet openings 50 are arranged in the anchoring region of the flame simulation elements 5 and thus inevitably flow against the flame simulation elements 5.

FIG. 1 also shows a programme controller 60 which engages both in the motor-operated drive 19 and in the light effects caused by the light sources 6, 7. Adjustment elements 61, which may serve to adjust the speed or to programme the programme controller 60, are provided on the programme controller 60. In addition, in order to improve the visual conditions, a diffuser plate 80 is represented, which runs approximately horizontally between the carrier element 11 and the fuel bed 3.

REFERENCE NUMERALS

1 Device
2 Housing
3 Fuel bed
4 Field of vision
5 Flame simulation element
6 Light source
7 Light source
8 Front
9 Viewing window
10 Plate
11 Carrier element
12 Drum
13 Shaft
14 Direction of arrow
15 Surface

16 Element
17 Plate
18 Angle of inclination
19 Drive
20 Belt
21 Roller
30 Shaft
31 Camshaft
40 Eccentric motor
41 Linking element
42 Camshaft
43 Direction of arrow
50 Air outlet openings
51 Blower
60 Programme controller
61 Adjustment element
70 Further light source
80 Diffuser plate
90 Carrier

What is claimed is:

1. Device for artificially simulating a fire, for use in a hearth of a fireplace, comprising:

a housing, within which a fire is simulated;

an artificial fuel bed;

strip-shaped, tongue-shaped or tab-shaped flame simulation elements whose image is reflected into a field of vision; and at least one light source for illuminating at least one of the fuel bed and flame simulation elements arranged within the housing, wherein the flame simulation elements are arranged on at least one moving, motor-driven carrier element;

wherein the flame simulation elements are positioned on the surface of the carrier element in such a way that they become released from the surface of the carrier element, pulled by gravity, so that they undergo a sudden movement; and wherein the carrier element is arranged in an upper part of the housing and the artificial fuel bed is arranged in a lower part of the housing and wherein at least one reflective element is arranged between the flame simulation elements and a surface of the fuel bed in order to reflect images of the flame simulation elements onto the fuel bed.

2. Device according to claim 1, comprising a motor-operated drive with electric motor.

3. Device according to claim 1, comprising a motor-operated drive with hot air blower.

4. Device according to claim 1, comprising a motor-operated drive with hydraulic motor.

5. Device according to claim 1, comprising a motor-operated drive with spring-operated lifting means or weight-operated lifting means.

6. Device according to claim 1, wherein the carrier element is a rotating drum.

7. Device according to claim 1, wherein the rotating drum carrier element (11) has different diameters in certain portions.

8. Device according to claim 1, wherein the carrier element (11) is a circulating belt (20).

9. Device according to claim 1, wherein a plurality of drum-like or wheel-like carrier elements (11) are arranged on a motor-driven shaft (13).

10. Device according to claim 1, wherein a plurality of drum-like or wheel-like carrier elements (11) are mounted on an axle and can be driven separately or in groups.

11. Device according to claim 1, wherein the carrier elements (11) are driven at different rotational speeds.

12. Device according to one of claims 10 or 11, wherein the carrier elements (11) are driven with different senses of rotation.

13. Device according to claim 1, wherein at least one of the carrier element is driven so as to rotate in an oscillating fashion or move forward and backward.

14. Device according to claim 1, wherein the carrier element (11) is embodied in the manner of a rotating camshaft.

15. Device according to claim 1, wherein the at least one carrier element executes at least one further movement in addition to a rotating movement.

16. Device according to claim 15, wherein the at least one carrier element executes an axial displacement or oscillation movement in addition to the rotating movement.

17. Device according to claim 1, wherein the carrier element (11) is provided with air outlet openings (50), and a blower (51) provides a flow onto an internal region of the carrier element (11).

18. Device according to claim 17, wherein the air outlet openings (50) are arranged in an anchoring region of the flame simulation elements (5) on a surface (15) of the carrier element (11).

19. Device according to claim 1, comprising a motor-operated drive is connected to a random generator in order to vary the speed.

20. Device according to claim 1, wherein a plurality of light sources are connected to a random generator or a programme controller.

21. Device according to claim 1, wherein a programme controller is provided both for a motor-operated drive and for a light effects.

22. Device according to claim 1, wherein at least one further light source is arranged within the carrier element.

23. Device according to claim 1, wherein additional light sources which can be switched on and off if appropriate are arranged on a surface of the carrier element.

24. Device according to claim 1, wherein the reflective element is formed by at least one, obliquely positioned plates.

25. Device according to claim 24, wherein the plates have different angles of inclination.

26. Device according to one claim 25, wherein the plates are curved or chased upwards.

27. Device according to claim 1, wherein adjustment elements for adjusting the speed or for programming a programme controller are provided.

28. Device according to claim 1, wherein the one of speed of the carrier element and the intensity of the light source can be reduced in the manner of a sloping curve by means of a timer.

29. Device according to claim 1, wherein a diffuser plate is arranged under the carrier element.

30. Device according to claim 1, wherein a front plate is arranged on the front of the housing.

* * * * *